US005956809A

United States Patent [19]

Hodgson

[11] Patent Number: 5,956,809

[45] Date of Patent: Sep. 28, 1999

[54] SELF-ALIGNING HINGE

[76] Inventor: Antony J. Hodgson, 4248 W. 11$^{th}$ St., Vancouver, British Columbia, Canada, V6R 2L7

[21] Appl. No.: 09/090,391

[22] Filed: Jun. 4, 1998

[51] Int. Cl.$^{6}$ ..... E05D 7/00

[52] U.S. Cl. ..... 16/224; 16/268; 16/273

[58] Field of Search ..... 16/224, 265, 268, 16/239, 235, 236, 275, 273

[56] References Cited

U.S. PATENT DOCUMENTS

| | | | |
|---|---|---|---|
| 197,126 | 11/1877 | Hasbrouck | 16/224 |
| 881,325 | 3/1908 | Manifold | 16/224 |
| 2,153,541 | 4/1939 | Atwood | 16/224 |
| 2,200,311 | 5/1940 | Van Voorhees | 16/224 |
| 2,265,049 | 12/1941 | Tucker | 16/224 |
| 2,748,420 | 6/1956 | Clover | 16/275 |
| 3,107,390 | 10/1963 | Shelton | 16/224 |
| 3,349,429 | 10/1967 | Suska | 16/224 |
| 3,832,754 | 9/1974 | Maertin et al. . | |
| 4,370,829 | 2/1983 | Wagner . | |
| 4,864,690 | 9/1989 | Chen . | |
| 5,150,500 | 9/1992 | Bisbing . | |
| 5,249,334 | 10/1993 | Hörberg et al. . | |
| 5,263,227 | 11/1993 | Hrbek et al. . | |

FOREIGN PATENT DOCUMENTS

| | | |
|---|---|---|
| 993612 | 7/1976 | Canada . |

*Primary Examiner*—Chuck Y. Mah
*Attorney, Agent, or Firm*—C. A. Rowley

[57] ABSTRACT

A hinge structure composed of a supporting hinge and aligning hinge. The supporting hinge is composed of a first and second part one of which has a first bearing with a spherical bearing portion the other a cooperating seat and preferably a cylindrical bearing surface opening therefrom. The first bearing cooperates with seat and the cylindrical bearing surface to support and prevent relative lateral movement of the first part while permitting rotational movement. The aligning hinge is formed of a second bearing having spherical bearing surface portion and a second hinge portion with a cylindrical bearing portion adapted to receive the second bearing in mating relation to permit rotation around the spherical axis of its spherical portion while preventing lateral movement.

20 Claims, 4 Drawing Sheets

SELF-ALIGNING HINGE

FIELD OF INVENTION

The present invention relates to a hinge, more particularly the present invention relates to a hinge structure to accommodate significant mis-alignment and facilitate installation.

BACKGROUND OF THE INVENTION

Conventional door hinges suffer from a number of well-known problems. They are difficult to install because vertical and angular positioning tolerances on the hinge plate are small. This makes it difficult to mount the hinges on the frame and the closure member such as a door and be sure that they are properly aligned relative to each other in the field when the closure is being mounted on the frame. Hence it is common practice to make pre-hung door assemblies in a factory using jigs or the like wherein alignment is performed under controlled assembly conditions and for the user to purchase such factory made pre-hung doors assemblies. Obviously, such assemblies are comparatively expensive.

It is also necessary to accurately align the cooperating hinge plates prior to putting the hinge pins into place which makes mounting the closure more difficult and time-consuming.

In use a conventional door hinge does not easily accommodate significant differential warping of the door and frame that occurs in may cases e.g. due to settling or humidity changes and thus results in "squeaky" hinges. Also conventional hinges are not mounted with the hinge pins on the outside to allow outward opening as this poses a security problem as the hinge pins are exposed and need only be removed to obtain entry.

A number of different hinge structures have been suggested and patented that attempt to overcome some of these difficulties including accommodating differential warping or some relative displacement of the frame and door or closure member.

Attention is directed to U.S. Pat. No. 4,370,829 issued Feb. 1, 1983 to Wagner, U.S. Pat. No. 4,864,690 issued Sep. 12, 1989 to Chen, U.S. Pat. No. 5,150,500 issued Sep. 29, 1992 to Bisbing, U.S. Pat. No. 5,249,334 issued Oct. 5, 1993 to Horberg et al. and U.S. Pat. No. 5,263,227 issued Nov. 23, 1993 to Hrbek et al. In all of these patented structures, at least one of the hinges is formed with a spherical mounting to accommodate relative angular displacement of the frame to and door. Most of these hinges are relatively complicated and do not permit easy assembly and some require bolting the hinge parts together.

Canadian patent 993612 issued Jul. 27, 1976 to Meertin et al. (see also U.S. Pat. No. 3,832,754 issued Sep. 3, 1974 to Meertin et al.) discloses a structure in which a supporting hinge uses a ball bearing or on a needle type bearing received in a shaped bearing (shallow socket) of the hinged member and an alignment hinge uses a substantially right cylindrical bearing enclosing the spherical member. This hinge structure accommodates significant misalignment, but is unstable as the supporting hinge may be easily dislodged laterally, for example, by simply overcoming the weight of the hinge member and slightly raising the one supporting hinge members to displace the ball or needle from its seat thereby freeing the member for lateral displacement and misalignment.

BRIEF DESCRIPTION OF THE PRESENT INVENTION

It is an object of the present invention to provide a stable self-aligning hinge structure, which is easily assembled and dissembled.

The present invention also permits mounting of the hinges with the pivot pins outside to permit outward opening of the closure without increasing security risks.

Broadly, the present invention relates to a hinge structure formed by a supporting hinge and aligning hinge. The supporting hinge has a first part and a second part one of which is mounted on a closure member and another, which is mounted on a frame. The first and second parts have cooperating bearings that support and permitting rotational movement around the bearing in any direction and translational movement nominally along a swing axis of the hinge structure but prevent relative lateral movement of the closure. The aligning hinge is formed by a third hinge part and a fourth hinge part one of which is connected to said closure and the other to said frame. The third and fourth hinge parts have cooperating bearing surfaces, which permit rotational movement in any direction and translational movement nominally along a swing axis of the hinge structure but prevent relative lateral movement. The supporting and aligning hinges each permit relative vertical movement of the closure and frame when the closure is in the open position to separate the closure from the frame.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
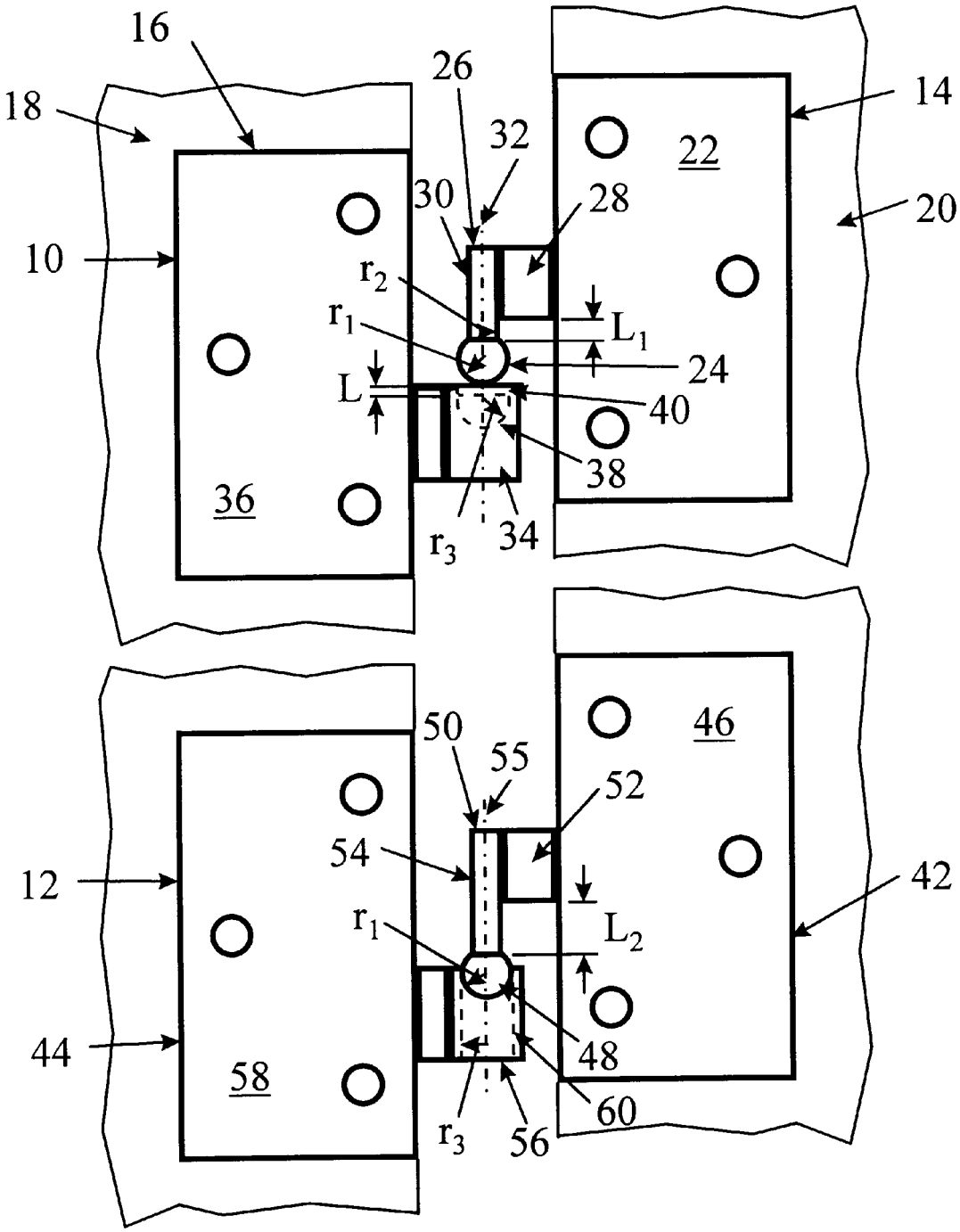
FIG. 1 is a side elevation illustrating a preferred embodiment of the hinge structure of the present invention.

As shown in FIG. 1, the present invention is composed of a supporting hinge structure 10 and aligning hinge structure 12. The supporting hinge structure is formed by a first part 14 and a second part 16, one of which is mounted on the frame and the other on the closure. In the preferred arrangement, the second part 16 is mounted on the frame 18 and the first part 14 is mounted on the closure 20.

The first part 14 is formed by a mounting element 22; i.e. a hinge plate that is screwed to or otherwise secured to the closure 20. Obviously, the closure may be any member to be swingably suspended by the hinge such as a door or the like. The first part 14 is provided with a first bearing element 24 that is substantially spherical where it contacts bearing element 34 near its equator and is connected to the mounting element 22 by a connecting element 26 having an offsetting portion 28 that offsets the bearing element 24 from the mounting element 22.

The connecting element 26 has a substantially vertically extending connecting portion 30 extending from and connecting the offset portion 28 with the bearing element 24 i.e. the portion 30 has its longitudinal axis substantially perpendicular to the longitudinal axis of the offset portion 28. The spherical radius of the bearing 24 is indicated as $r_1$ and the maximum radius of the connecting portion 30 of the connecting element 26 is indicated by the radius $r_2$, measured from the substantially vertical swing axis 32 as represented by the arrow 32. It is apparent that the cross section of the connecting portion 30 need not be circular, thus another way of defining the maximum radius $r_2$ is that it is the maximum offset of the periphery of that portion of the length of the connecting portion 30 received within the bearing socket 38 and extension 40 of the second portion 16 (described below) relative to the axis 32 i.e. the member 30 must be constructed so that it provides the required clearance to permit the required amount of angular misalignent of the hinge structure without contacting the bearing portion 34.

The second portion 16 of the supporting hinge structure 10 is composed of a mounting element 36 and the bearing element 34. Bearing element 34 has a cavity forming a substantially spherical bearing seat portion 38 opening into a cylindrical portion 40 i.e. substantially vertical surrounding wall to prevent relative lateral movement. The spherical bearing 38 and the cylindrical portion 40 have substantially the same radius $r_3$. The radius $r_3$ of the cylindrical bearing portion 38 and cylindrical portion 40 is substantially equal to the radius $r_1$ of the bearing element 24 with the required tolerances to permit the spherical bearing element 24 to seat in the seating bearing 38 of the bearing element 34. Axial length of the cylindrical section 40 as indicated by the length L. The length L may be 0 i.e. the bearing element will have only a socket 38, but it is preferred that L be greater than 0 so that the closure 20 must be lifted a reasonable distance before lateral movement is permitted generally L=0.25 to about $L=r_1$ will be satisfactory for most applications (obviously if desired L could be made longer). It is preferred that the bearing seat 38 and cylindrical portion 40 receive the bearing 24 to a depth at least slightly greater than the radius $r_1$ to prevent lateral movement between bearing element 34 and bearing element 24 when the two are in mating engagement. It is preferred that the length L of the cylindrical portion 40 be at least 10% of the radius $r_1$ so that significant movement of the first portion 14 of the hinge 10 relative to the second portion 16 of the hinge 10 is required before lateral displacement of the closure 20 relative to the frame 18 may occur and so that lateral force vectors applied to the closure 20 do not laterally displace the closure 20 subject to failure of the material from which the hinge is made.

The radius $r_1$ is significantly larger than the radius $r_2$ to provide a clearance C (not shown) to permit angular misalignment of the hinge structure. This clearance is formed by the difference in radius $r_1$ and $r_2$ at the end of the portion 40 remote from the seat 38 i.e. it is only the clearance $C=r_1-r_2$ measured at the location where portion 30 would first contact the portion 40 when there is misalignment that must be sufficient to accommodate the misalignment. This clearance C in combination with the length L determines the freedom of the part 14 to rotate in any direction other than around the axis 30 and need not be large if the axial length L of the cylindrical portion 40 of the second bearing element 34 is small. This clearance between the portion 30 and the portion 40 at the end of the portion 40 remote from the bearing 38 defines the maximum permitted angle of misalignment of the hinge part 14 relative to the axis 32 and thus also defines the amount or extent of the portion of the surface of bearing 24 that needs to be substantially spherical to permit this amount of angular misalignment.

The alignment hinge structure 12 is formed by a third hinge part 42 and a fourth hinge part 44. Hinge part 42 is essentially the same as the first hinge part except as described below and is formed by a third mounting element 46, a third bearing element 48 interconnected by a third interconnecting portion 50 formed by a second offsetting portion 52 and a second substantially vertical connecting section or portion 54.

The fourth hinge part 44 is composed of a mounting element 58 and the bearing element 56 connected thereto and projecting therefrom. The fourth bearing element 56 has an internal bore 60 which forms a fourth bearing to receive the bearing element 48.

The radius of the spherical portion of the surface of bearing element 48 will preferably be essentially the same as the radius $r_1$ of the bearing element 24 and the radius of the cylindrical bearing 60 will preferably be essentially the same as the radius $r_3$ of the spherical bearing seat 38 to receive the bearing 48 and permitting rotation while minimizing lateral movement. Similarly the radius of the connecting section 54 at the appropriate location (i.e. where the section 54 would first contact the bearing 60) will be such as to provide the required clearance C at this point of first contact as above described to accommodate the desired amount of misalignment.

Obviously only a portion of the surface of the bearing element 48 adjacent to its equator measured substantially perpendicular to the (vertical) axis 55 need be spherical. The extent of the spherical portion is as above described for the bearing 24 determined by the permitted angular deviation.

Preferably, the length of the offset section 28 and 52 will be essentially the same so that the offset of the bearing 24 from the mounting element 22 and the offset of the bearing 48 from the mounting element 46 will be essentially the same.

The axial length $L_1$ of the connecting portions 30 and the axial the length $L_2$ of the connecting section 54 of the second offset element 50 preferably are such that the length $L_1$ is significantly shorter than the length $L_2$ so that the third bearing element 48 is received in its mating bearing element 56 before the first bearing element 24 is received in a second bearing element 38 to facilitate mounting of the door.

In the illustration, supporting hinge 10 is mounted adjacent to the top and alignment hinge 12 at the bottom; however, the position of the two hinges 10 and 12 could be exchanged.

Preferably, the first and third hinge parts 14 and 42 are mounted on the closure 20. However, by inverting the hinges, the second and fourth parts 16 and 44 could be mounted on the closure 20.

The mating bearings 24 and 38 and 48 and 60 are designed to inhibit lateral movement, thus, the term spherical is intended to include curve structures that will substantially prevent lateral movement but will permit rotation in any other direction. With respect to the bearing surfaces 24 and 38, the bearings 24 and 38 must not only prevent lateral movement, but also must provide vertical support for the closure 20. Thus, it is preferred that the bottom end of the bearing 24 the main seat of the bearing 38 be substantially spherical to provide the maximum support bearing surface for the closure 20 since the closure 20 is supported solely by the direction between bearings 24 and 38.

Figure 2:
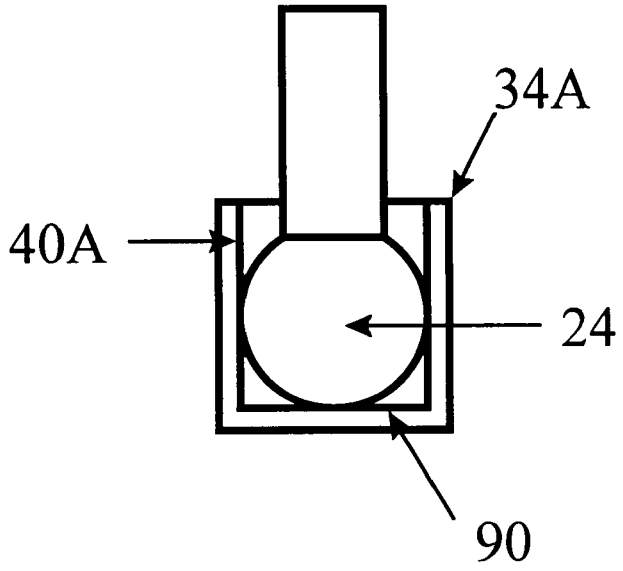
FIGS. 2, 3 and 4 show other embodiments of supporting hinge structures for the present invention.
Figure 3:
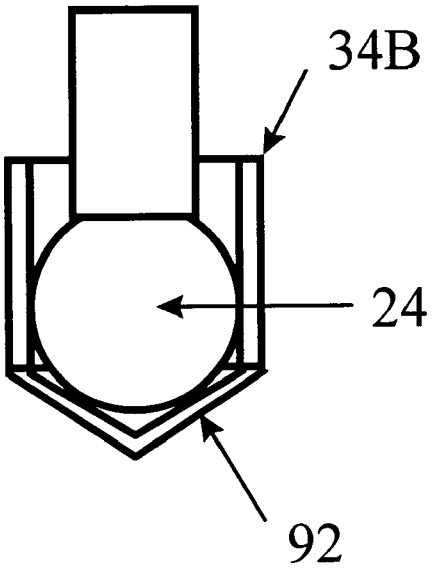
Figure 4:
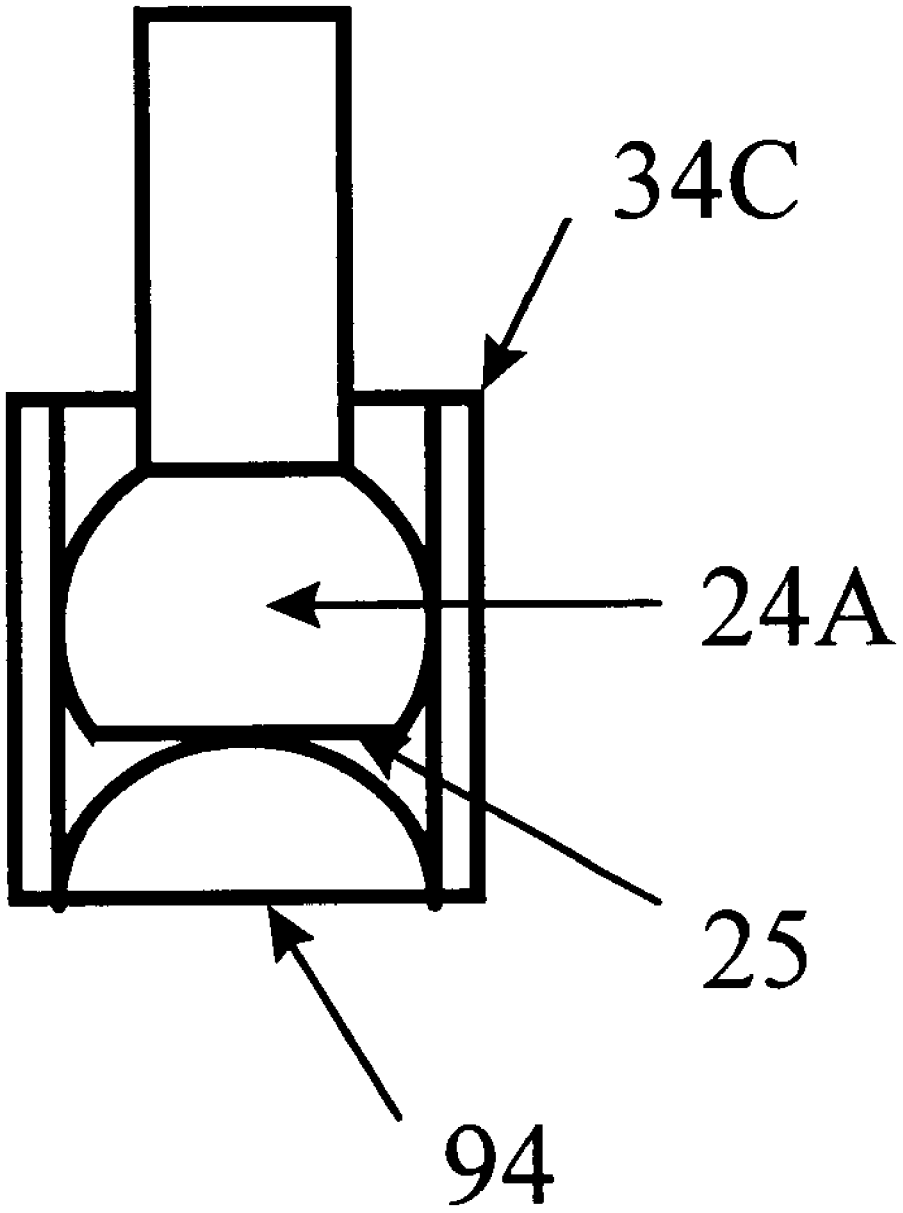

Modifications of the bearing seat 38 are shown in FIGS. 2, 3 and 4.

As shown in FIG. 2 the bearing member 34 is replaced by a cylindrical cup 34A which receives the spherical bearing 24 on its flat bottom 90 that replaces seat 38 and is contained by the cylindrical portion 40A. The cylindrical portion 40A will have an internal radius equivalent to radius $r_3$ to accommodate the spherical bearing 24.

The FIG. 3 embodiment is the same as the FIG. 2 embodiment except that in the bearing 34B the flat bottom 90 has been replace by a conical bottom 92 so the Bearing 24 makes line contact with the seat 92 as opposed to the point contact provided by the seat 90.

FIG. 4 is similar to FIGS. 2 and 3 but the bottom seat 94 of the bearing 34C is curved, while the mating portion of the bearing 24A replacing bearing 24 is substantially planar and defines a plane substantially perpendicular to the axis 32.

Other variations in which point, line or patch contact occur while allowing for freedom of rotation are also acceptable.

Figure 5:
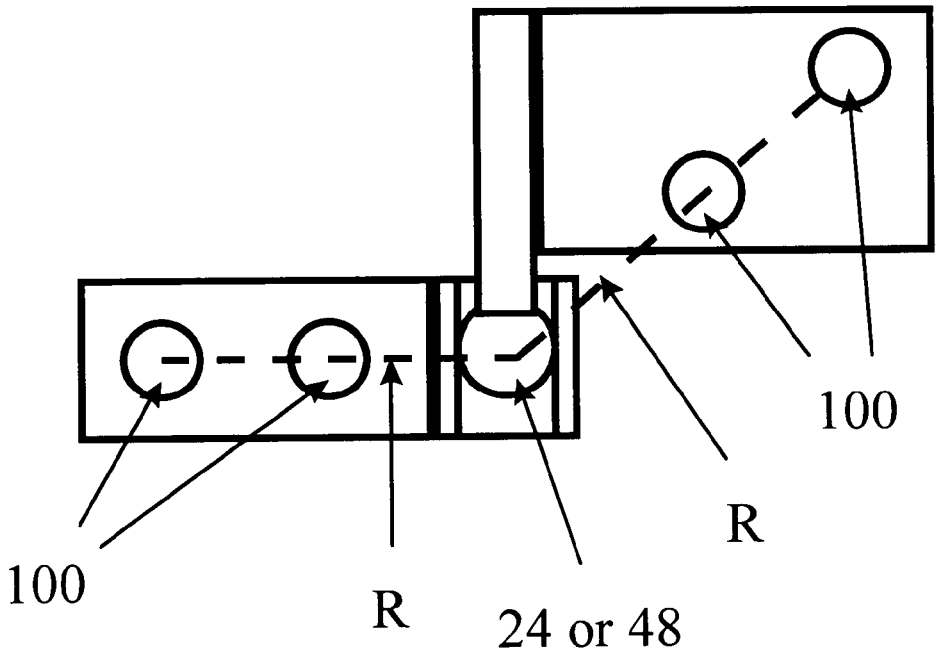
FIGS. 5 and 6 illustrate how different mounting plates may be mounted on the frame and closure.
Figure 6:
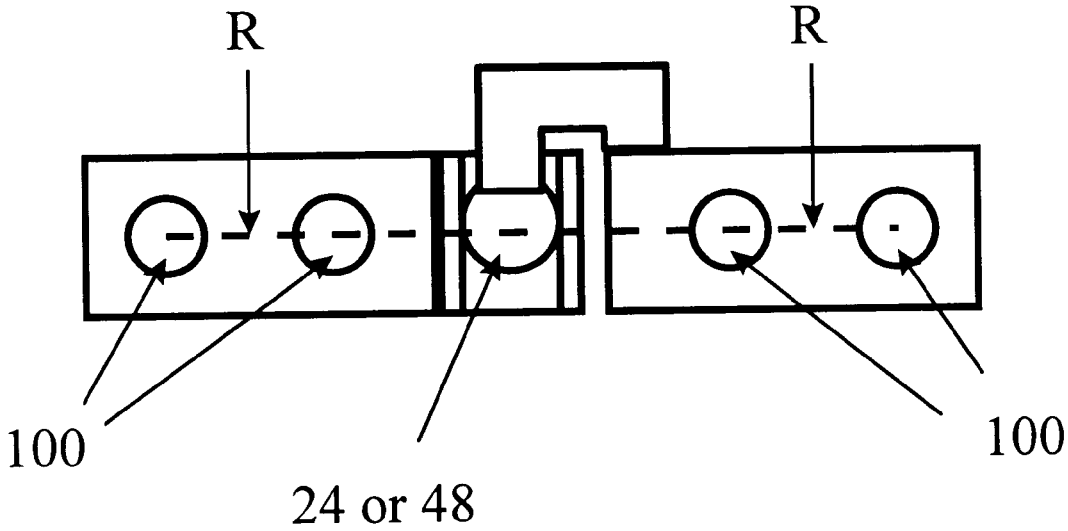

The design of the present invention permits modification of the hinge plate as shown in FIGS. 5 and 6 to use only 2 screws and much less material than conventional hinges by aligning the screw holes 100 substantially radial to the spherical bearings 24 or 48 as indicated by the dotted lines labeled R. This is possible since effectively all the forces carried by the hinge act through the centre of the bearings 24 or 48.

It will be apparent that the present invention provides a relatively simple yet effective hinge structure that may be easily assembled or disassembled and will accommodate warpage or ease in orientation between the hinge parts as may be caused by the normal imperfections that occur in structures. The hinge structure of the present invention permits rotation in any direction and translational movement nominally along a swing axis of the hinge structure while preventing lateral movement when the bearings are properly seated.

To assemble a hinge, the interconnected hinge portions 14 and 42 are positioned with the bearing elements 48 and 24 above their respective bearings 60 and 38 in the cooperating hinge portions 16 and 44. The bearing 48 is then moved into its receiving bearing 60 and then position the bearing 24 to be received in the bearing seat 38 (90, 92 or 94) and moving the bearing onto the seat 38 (90, 92 or 94) to complete the installation, i.e. only the bottom in this case, bearings 48 and 60 need be aligned at the commencement of the mounting option when these are in place, the bearings 24 and 38 are aligned and are dropped into position.

It will take significant vertical movement to permit lateral movement of the closure, the amount of which upward movement required being determined by the length L, in which case L will be sufficient to accommodate reasonable movement of closure.

The weight of the closure 20 provides the sole force holding the hinges together and the closure in position on the frame 18. To remove the closure 20 it is only necessary to open the closure and then lift it so that the bearings 24 and 48 clear their respective cooperating mounting members 34 and 56.

Having described the invention, modifications will be evident to those skilled in the art without departing from the scope of the invention as defined in the appended claims.

I claim:

1. A hinge structure comprising a supporting hinge and aligning hinge, a supporting hinge having a first part and a second part, one of which is mounted on a closure member and another which is mounted on a frame, said first part being formed by a first mounting element, a first bearing element having bearing surface with a substantially spherical bearing surface portion and a first connecting element interconnecting said first mounting element with said first bearing element, said second part having a second mounting element and a second bearing element, said second bearing element defining an upwardly opening cooperating bearing seat for said first bearing element, said cooperating bearing seat receiving and acting with said first bearing element to support said closure member and with said spherical bearing surface portion to substantially prevent lateral displacement of said first bearing element relative to said second bearing element while permitting rotational movement in any direction on said spherical bearing surface portion, said aligning hinge comprising a third hinge part and a fourth hinge part, one of said third and fourth hinge parts being connected to said closure and the other to said frame, said third hinge part being formed by a third mounting element, a third bearing element and a second connecting element interconnecting said third mounting element and said third bearing element to maintain said third bearing element spaced from said third mounting element, said fourth part comprising a fourth mounting element and a fourth bearing element, said third bearing element having a second substantially spherical shaped bearing surface portion and said fourth bearing surface having a substantially cylindrical bearing surface to receive said second spherical bearing surface portion to permit rotational movement of said third bearing element and axial movement of said third bearing element along a longitudinal axis of said cylindrical bearing surface while preventing lateral movement of said third bearing element relative to said fourth bearing element, said first and second bearing elements forming substantially the sole vertical support for said closure and weight of said closure providing substantially the sole force preventing separation of said first bearing element from said second bearing element.

2. A hinge structure as defined in claim 1 wherein said seat comprises a support bearing portion and a first substantially cylindrical bearing surface extending upwardly therefrom and having an axial length L, said first substantially cylindrical bearing surface acting with said spherical bearing surface portion of said first bearing element to prevent lateral displacement of said first bearing element relative to said second bearing element when said spherical bearing surface portion of said first bearing is received in said first cylindrical bearing surface while permitting rotation in substantially all directions.

3. A hinge structure as defined in claim 2 wherein said first and second interconnecting members each includes a connecting portion with one end connected to its bearing element and its other end connected to an offsetting portion connecting it to its mounting element, said offsetting portion positioning its bearing member spaced from its mounting member, said connecting portion having a maximum offset from a longitudinal axis of said connecting portion significantly smaller than the diameter of said spherical bearing surface portion of its bearing element.

4. A hinge structure as defined in claim 3 wherein said bearing seat is substantially semi-spherical and has essentially the same diameter as said first cylindrical bearing surface.

5. A hinge structure as defined in claim 3 wherein each of said mounting portions are provided with mounting hole positioned on a common radius from its spherical bearing surface portion.

6. A hinge structure as defined in claim 2 wherein said connecting portion of said first connecting element is axially shorter than said connecting portion of said second connecting element and said mounting elements are mounted on said closure and said frame so that said third bearing element is received in said fourth bearing element before said first bearing element is received in said second bearing element as said closure is being mounted on said frame via said hinges.

7. A hinge structure as defined in claim 5 wherein said first cylindrical bearing surface is an upwardly opening tube and said bearing seat of said second bearing element forms the bottom of said tube.

8. A hinge structure as defined in claim 6 wherein said bearing seat is substantially semi-spherical and has essentially the same diameter as said first cylindrical bearing surface.

9. A hinge structure as defined in claim 6 wherein each of said mounting portions are provided with mounting hole positioned on a common radius from its spherical bearing surface portion.

10. A hinge structure as defined in claim 2 wherein said cylindrical bearing surface is an open ended tubular structure.

11. A hinge structure as defined in claim 2 wherein said first cylindrical bearing surface is an upwardly opening tube and said bearing seat of said second bearing element forms the bottom of said tube.

12. A hinge structure as defined in claim 11 wherein said cylindrical bearing surface is an open ended tubular structure.

13. A hinge structure as defined in claim 11 wherein said bearing seat is substantially semi-spherical and has essentially the same diameter as said first cylindrical bearing surface.

14. A hinge structure as defined in claim 2 wherein said bearing seat is substantially semi-spherical and has essentially the same diameter as said first cylindrical bearing surface portion.

15. A hinge structure as defined in claim 2 wherein each of said mounting portions are provided with mounting hole positioned on a common radius from its spherical bearing surface portion.

16. A hinge structure as defined in claim 1 wherein said first and second interconnecting members each includes a connecting portion with one end connected to its bearing element and its other end connected to an offsetting portion connecting it to its mounting element, said offsetting portion positioning its bearing member spaced from its mounting member, said connecting portion having a maximum offset from a longitudinal axis of said connecting portion significantly smaller than the diameter of said spherical bearing surface portion of its bearing element.

17. A hinge structure as defined in claim 16 wherein each of said mounting portions are provided with mounting hole positioned on a common radius from its spherical bearing surface portion.

18. A hinge structure as defined in claim 1 wherein said first cylindrical bearing surface is an upwardly opening tube and said bearing seat of said second bearing element forms the bottom of said tube.

19. A hinge structure as defined in claim 18 wherein said cylindrical bearing surface is an open ended tubular structure.

20. A hinge structure as defined in claim 1 wherein each of said mounting portions are provided with mounting hole positioned on a common radius from its spherical bearing surface portion.

* * * * *